US008365808B1

(12) United States Patent
Tilak et al.

(10) Patent No.: US 8,365,808 B1
(45) Date of Patent: Feb. 5, 2013

(54) PROCESS AND APPARATUS FOR MINIMIZING THE POTENTIAL FOR EXPLOSIONS IN THE DIRECT CHILL CASTING OF ALUMINUM LITHIUM ALLOYS

(75) Inventors: Ravindra V. Tilak, Orange, CA (US); Rodney W. Wirtz, Lake Forrest, CA (US); Ronald M. Streigle, Anaheim, CA (US)

(73) Assignee: Almex USA, Inc., Buena Park, CA (US)

( * ) Notice: Subject to any disclaimer, the term of this patent is extended or adjusted under 35 U.S.C. 154(b) by 0 days.

(21) Appl. No.: 13/474,614

(22) Filed: May 17, 2012

(51) Int. Cl.
*B22D 11/00* (2006.01)
*B22D 11/049* (2006.01)

(52) U.S. Cl. ..... 164/487; 164/444; 164/475; 164/415

(58) Field of Classification Search ..... 164/415, 164/444, 475, 487
See application file for complete search history.

(56) References Cited

U.S. PATENT DOCUMENTS

| | | | |
|---|---|---|---|
| 2,863,558 | A | 12/1958 | Brondyke et al. |
| 3,006,473 | A | 10/1961 | Gamber |
| 3,235,089 | A | 2/1966 | Burroughs |
| 3,281,238 | A | 10/1966 | Bachowski et al. |
| 3,451,465 | A | 6/1969 | Moritz et al. |
| 3,524,548 | A | 8/1970 | McDonald et al. |
| 3,895,937 | A | 7/1975 | Gjosteen et al. |
| 3,947,363 | A | 3/1976 | Pryor et al. |
| 4,113,241 | A | 9/1978 | Dore |
| 4,188,884 | A | 2/1980 | White et al. |
| 4,214,624 | A | 7/1980 | Foye et al. |
| 4,221,589 | A | 9/1980 | Verstraelen |
| 4,237,961 | A | 12/1980 | Zinniger |
| 4,248,630 | A | 2/1981 | Balmuth |
| 4,355,679 | A | 10/1982 | Wilkins |
| 4,395,333 | A | 7/1983 | Groteke |
| 4,427,185 | A | 1/1984 | Meyer |
| 4,444,377 | A | 4/1984 | Groteke et al. |
| 4,501,317 | A | 2/1985 | Sokolowski |
| 4,528,099 | A | 7/1985 | Rieger et al. |
| 4,556,535 | A | 12/1985 | Bowman et al. |
| 4,567,936 | A | 2/1986 | Binczewski |
| 4,581,295 | A | 4/1986 | DeLiso et al. |
| 4,582,118 | A | 4/1986 | Jacoby et al. |
| 4,593,745 | A | 6/1986 | Yu et al. |

(Continued)

FOREIGN PATENT DOCUMENTS

| | | |
|---|---|---|
| CA | 1309870 | 11/1992 |
| CN | 101648265 | 2/2010 |

(Continued)

OTHER PUBLICATIONS

"Semi-Continuous Casting Plant Produces Aluminium-Lithium Alloys", Met. Ind. News 3, (Sep. 1986), Abstract.

(Continued)

*Primary Examiner* — Kuang Lin
(74) *Attorney, Agent, or Firm* — Blakely Sokoloff Taylor & Zafman LLP

(57) ABSTRACT

Steam exhaust ports are located around a perimeter of a direct chill casting pit, at various locations from below the top of the pit to the pit bottom to rapidly remove steam from the casting pit with addition of dry excess air. Gas introduction ports are also located around a perimeter of the casting pit and configured to introduce an inert gas into the casting pit interior.

19 Claims, 2 Drawing Sheets

U.S. PATENT DOCUMENTS

| | | | |
|---|---|---|---|
| 4,597,432 | A | 7/1986 | Collins et al. |
| 4,598,763 | A | 7/1986 | Wagstaff et al. |
| 4,607,679 | A | 8/1986 | Tsai et al. |
| 4,610,295 | A | 9/1986 | Jacoby et al. |
| 4,628,985 | A | 12/1986 | Jacoby et al. |
| 4,640,497 | A | 2/1987 | Heamon |
| 4,651,804 | A | 3/1987 | Grimes et al. |
| 4,709,740 | A | 12/1987 | Jacoby et al. |
| 4,709,747 | A | 12/1987 | Yu et al. |
| 4,724,887 | A | 2/1988 | Jacoby et al. |
| 4,761,266 | A | 8/1988 | Bruski |
| 4,769,158 | A | 9/1988 | Eckert |
| 4,770,697 | A | 9/1988 | Zurecki |
| 4,773,470 | A | 9/1988 | Libby et al. |
| 4,781,239 | A | 11/1988 | Cans et al. |
| 4,858,674 | A | 8/1989 | Enright |
| 4,930,566 | A | 6/1990 | Yanagimoto et al. |
| 4,947,925 | A | 8/1990 | Wagstaff et al. |
| 4,964,993 | A | 10/1990 | Stankiewicz |
| 4,986,337 | A | 1/1991 | Soulier |
| 5,028,570 | A | 7/1991 | Winkelbauer et al. |
| 5,032,171 | A | 7/1991 | Robare et al. |
| 5,052,469 | A | 10/1991 | Yanagimoto et al. |
| 5,091,149 | A | 2/1992 | Shin et al. |
| 5,167,918 | A | 12/1992 | Shin et al. |
| 5,176,197 | A | 1/1993 | Hamaguchi et al. |
| 5,185,297 | A | 2/1993 | Park et al. |
| 5,212,343 | A | 5/1993 | Brupbacher et al. |
| 5,320,803 | A | 6/1994 | Webster |
| 5,369,063 | A | 11/1994 | Gee |
| 5,404,813 | A | 4/1995 | Wong |
| 5,415,220 | A | 5/1995 | Edwards |
| 5,427,602 | A | 6/1995 | DeYoung et al. |
| 5,441,919 | A | 8/1995 | Park et al. |
| 5,845,481 | A | 12/1998 | Briesch et al. |
| 5,846,481 | A | 12/1998 | Tilak |
| 5,873,405 | A | 2/1999 | Carrier et al. |
| 6,069,910 | A | 5/2000 | Eckert |
| 6,279,645 | B1 | 8/2001 | McGlade et al. |
| 6,393,044 | B1 | 5/2002 | Fishman et al. |
| 6,398,844 | B1 | 6/2002 | Hobbs et al. |
| 6,491,087 | B1 | 12/2002 | Tilak |
| 6,551,424 | B1 | 4/2003 | Haszler et al. |
| 6,675,870 | B2 | 1/2004 | Tilak |
| 6,808,009 | B2 | 10/2004 | Anderson |
| 6,837,300 | B2 | 1/2005 | Cooper et al. |
| 7,000,676 | B2 | 2/2006 | Chu et al. |
| 7,204,295 | B2 | 4/2007 | Schneider et al. |
| 7,296,613 | B2 | 11/2007 | Anderson et al. |
| 7,550,028 | B2 | 6/2009 | Riquet et al. |
| 8,056,611 | B2 | 11/2011 | Gildemeister et al. |
| 2009/0269239 | A1 | 10/2009 | Nagakura et al. |
| 2011/0209843 | A2 | 9/2011 | Bes et al. |
| 2011/0247456 | A1 | 10/2011 | Rundquist et al. |

FOREIGN PATENT DOCUMENTS

| | | |
|---|---|---|
| CN | 101967588 | 2/2011 |
| CN | 201892583 | 7/2011 |
| EP | 0090583 | 10/1983 |
| EP | 0109170 | 5/1984 |
| EP | 0142341 | 5/1985 |
| EP | 0150922 | 8/1985 |
| EP | 0183563 | 6/1986 |
| EP | 0229211 | 7/1987 |
| EP | 0229218 | 7/1987 |
| EP | 0281238 | 9/1988 |
| EP | 0295008 | 12/1988 |
| EP | 0364097 | 4/1990 |
| EP | 0726114 | 8/1996 |
| JP | 8268745 | 10/1996 |
| RU | 2048568 | 11/1995 |
| RU | 2261933 | 10/2005 |
| WO | WO-8702069 | 4/1987 |
| WO | WO-2010094852 | 8/2010 |

OTHER PUBLICATIONS

Nair, C. G., et al., "Technology for Aluminium-Lithium Alloy Production—Ingot Casting Route", Science and Technology of Aluminium-Lithium Alloys, Bangalore, India, (Mar. 4-5, 1989), Abstract.

Ohara, K., et al., "Hot-tearing of Al-Li alloys in DC casting", 4th International Conference on Aluminum Alloys: Their Physical and Mechanical Properties, vol. II, (Sep. 11-16, 1994), Abstract.

Page, F. M., et al., "The Safety of Molten Aluminium-Lithium Alloys in the Presence of Coolants", Journal de Physique 48, Supplement No. 9, (Sep. 1987), C3-63-C3-73.

PROCESS AND APPARATUS FOR MINIMIZING THE POTENTIAL FOR EXPLOSIONS IN THE DIRECT CHILL CASTING OF ALUMINUM LITHIUM ALLOYS

FIELD

Direct chill casting of aluminum lithium (Al—Li) alloys.

BACKGROUND

Traditional (non-lithium containing) aluminum alloys have been semi-continuously cast in open bottomed molds since the invention of Direct Chill ("DC") casting in the 1938 by the Aluminum Company of America (now Alcoa). Many modifications and alterations to the process have occurred since then, but the basic process and apparatus remain similar. Those skilled in the art of aluminum ingot casting will understand that new innovations improve the process, while maintaining its general functions.

U.S. Pat. No. 4,651,804 describes a more modern aluminum casting pit design. It has become standard practice to mount the metal melting furnace slightly above ground level with the casting mould at, or near to, ground level and the cast ingot is lowered into a water containing pit as the casting operation proceeds. Cooling water from the direct chill flows into the pit and is continuously removed there-from while leaving a permanent deep pool of water within the pit. This process remains in current use and, throughout the world, probably in excess of 5 million tons of aluminum and its alloys are produced annually by this method.

Unfortunately, there is inherent risk from a "bleed-out" or "run-out" using such systems. A "bleed out" or "run out" occurs where the aluminum ingot being cast is not properly solidified in the casting mold, and is allowed to leave the mold unexpectedly and prematurely while in a liquid state. Molten aluminum in contact with water during a "bleed-out" or "run-out" can cause an explosion from (1) conversion of water to steam from the thermal mass of the aluminum heating the water to >212° F. or (2) the chemical reaction of the molten metal with the water resulting in release of energy causing an explosive chemical reaction.

There have been many explosions throughout the world when "bleed outs" "run-outs" have occurred in which molten metal escaped from the sides of the ingot emerging from the mold and/or from the confines of the mold, using this process. In consequence, considerable experimental work has been carried out to establish the safest possible conditions for DC casting. Among the earliest and perhaps the best known work was undertaken by G. Long of the Aluminum Company of America ("Metal Progress" May 1957 pages 107 to 112) (hereinafter referred to as "Long") that was followed by further investigations and the establishment of industry "codes of practice" designed to minimize the risk of explosion. These codes are generally followed by foundries throughout the world. The codes are broadly based upon Long's work and usually require that: (1) the depth of water permanently maintained in the pit should be at least three feet; (2) the level of water within the pit should be at least 10 feet below the mold; and (3) the casting machine and pit surfaces should be clean, rust free and coated with proven organic material.

In his experiments, Long found that with a pool of water in the pit having a depth of two inches or less, very violent explosions did not occur. However, instead, lesser explosions took place sufficient to discharge molten metal from the pit and distribute this molten metal in a hazardous manner externally of the pit. Accordingly the codes of practice, as stated above, require that a pool of water having a depth of at least three feet is permanently maintained in the pit. Long had drawn the conclusion that certain requirements must be met if an aluminum/water explosion is to occur. Among these was that a triggering action of some kind must take place on the bottom surface of the pit when it is covered by molten metal and he suggested that this trigger is a minor explosion due to the sudden conversion to steam of a very thin layer of water trapped below the incoming metal. When grease, oil or paint is on the pit bottom an explosion is prevented because the thin layer of water necessary for a triggering explosion is not trapped beneath the molten metal in the same manner as with an uncoated surface.

In practice, the recommended depth of at least three feet of water is generally employed for vertical DC casting and in some foundries (notably in continental European countries) the water level is brought very close to the underside of the mold in contrast to recommendation (2) above. Thus the aluminum industry, casting by the DC method, has opted for the safety of a deep pool of water permanently maintained in the pit. It must be emphasized that the codes of practice are based upon empirical results; what actually happens in various kinds of molten metal/water explosions is imperfectly understood. However, attention to the codes of practice has ensured the virtual certainty of avoiding accidents in the event of "run-outs" with aluminum alloys.

In the last several years, there has been growing interest in light metal alloys containing lithium. Lithium makes the molten alloys more reactive. In the above mentioned article in "Metal Progress", Long refers to previous work by H. M. Higgins who had reported on aluminum/water reactions for a number of alloys including Al—Li and concluded that "When the molten metals were dispersed in water in any way Al—Li alloy underwent a violent reaction." It has also been announced by the Aluminum Association Inc. (of America) that there are particular hazards when casting such alloys by the DC process. The Aluminum Company of America has published video recordings of tests that demonstrate that such alloys can explode with great violence when mixed with water.

U.S. Pat. No. 4,651,804 teaches the use of the aforementioned casting pit, but with the provision of removing the water from the bottom of the cast pit such that no buildup of a pool of water in the pit occurs. This arrangement is their preferred methodology for casting Al—Li alloys. European Patent No. 0-150-922 describes a sloped pit bottom (preferably three percent to eight percent inclination gradient of the pit bottom) with accompanying off-set water collection reservoir, water pumps, and associated water level sensors to make sure water cannot collect in the cast pit, thus reducing the incidence of explosions from water and the Al—Li alloy having intimate contact. The ability to continuously remove the ingot coolant water from the pit such that a build-up of water cannot occur is critical to the success of the patent's teachings.

Other work has also demonstrated that the explosive forces associated with adding lithium to aluminum alloys can increase the nature of the explosive energy several times than for aluminum alloys without lithium. When molten aluminum alloys containing lithium come into contact with water, there is the rapid evolution of hydrogen, as the water dissociates to Li—OH and hydrogen ion ($H^+$). U.S. Pat. No. 5,212,343 teaches the addition of aluminum, lithium (and other elements as well) with water to initiate explosive reactions. The exothermic reaction of these elements (particularly aluminum and lithium) in water produces large amounts of hydrogen gas, typically 14 cubic centimeters of hydrogen gas per one gram of aluminum –3% lithium alloy. Experimental verifications of this data can be found in the research carried out under US Department of Energy funded research contract number # DE-AC09-89SR18035. Note that claim 1 of the U.S. Pat. No. 5,212,343 claims the method to perform this intense interaction for producing a water explosion via the exothermic reaction. This patent describes a process wherein the addition of elements such as lithium results in a high energy of reaction per unit volume of materials. As described in U.S. Pat. Nos. 5,212,343 and 5,404,813, the addition of lithium (or some other chemically active element) promotes an explosion. These patents teach a process where an explosive reaction is a desirable outcome. These patents reinforce the explosiveness of the addition of lithium to the "bleed-out" or "run-out", as compared to aluminum alloys without lithium.

Referring again to the U.S. Pat. No. 4,651,804, the two occurrences that result in explosions for conventional (non-lithium bearing) aluminum alloys are (1) conversion of water to steam and (2) the chemical reaction of molten aluminum and water. The addition of lithium to the aluminum alloy produces a third, even more acute explosive force, the exothermic reaction of water and the molten aluminum-lithium "bleed-out" or "run-out" producing hydrogen gas. Any time the molten Al—Li alloy comes into contact with water, the reaction will occur. Even when casting with minimum water levels in the casting pit, the water comes into contact with the molten metal during a "bleed-out" or "run-out". This cannot be avoided, only reduced, since both components (water and molten metal) of the exothermic reaction will be present in the casting pit. Reducing the amount of water-to-aluminum contact will eliminate the first two explosive conditions, but the presence of lithium in the aluminum alloy will result in hydrogen evolution. If hydrogen gas concentrations are allowed to reach a critical mass and/or volume in the casting pit, explosions are likely to occur. The volume concentration of hydrogen gas required for triggering an explosion has been researched to be at a threshold level of 5% of volume of the total volume of the mixture of gases in a unit space. U.S. Pat. No. 4,188,884 describes making an underwater torpedo warhead, and recites page 4, column 2, line 33 referring to the drawings that a filler 32 of a material which is highly reactive with water, such as lithium is added. At column 1, line 25 of this same patent it is stated that large amounts of hydrogen gas are released by this reaction with water, producing a gas bubble with explosive suddenness.

U.S. Pat. No. 5,212,343 describes making an explosive reaction by mixing water with a number of elements and combinations, including Al and Li to produce large volumes of hydrogen containing gas. On page 7, column 3, it states "the reactive mixture is chosen that, upon reaction and contact with water, a large volume of hydrogen is produced from a relatively small volume of reactive mixture." Same paragraph, lines 39 and 40 identify aluminum and lithium. On page 8, column 5, lines 21-23 show aluminum in combination with lithium. On page 11 of this same patent, column 11, lines 28-30 refer to a hydrogen gas explosion.

In another method of conducting DC casting, patents have been issued related to casting Al-LI alloys using an ingot coolant other than water to provide ingot cooling without the water-lithium reaction from a 'bleed-out" or "run-out". U.S. Pat. No. 4,593,745 describes using a halogenated hydrocarbon or halogenated alcohol as ingot coolant. U.S. Pat. Nos. 4,610,295; 4,709,740, and 4,724,887 describe the use of ethylene glycol as the ingot coolant. For this to work, the halogenated hydrocarbon (typically ethylene glycol) must be free of water and water vapor. This is a solution to the explosion hazard, but introduces strong fire hazard and is costly to implement and maintain. A fire suppression system will be required within the casting pit to contain potential glycol fires. To implement a glycol based ingot coolant system including a glycol handling system, a thermal oxidizer to de-hydrate the glycol, and the casting pit fire protection system generally costs on the order of $5 to $8 million dollars (in today's dollars). Casting with 100% glycol as a coolant also brings in another issue. The cooling capability of glycol or other halogenated hydrocarbons is different than that for water, and different casting practices as well as casting tooling are required to utilize this type of technology. Another disadvantage affiliated with using glycol as a straight coolant is that because glycol has a lower heat conductivity and surface heat transfer coefficient than water, the microstructure of the metal cast with 100% glycol as a coolant has coarser undesirable metallurgical constituents and exhibits higher amount of centerline shrinkage porosity in the cast product. Absence of finer microstructure and simultaneous presence of higher concentration of shrinkage porosity has a deleterious effect on the properties of the end products manufactured from such initial stock.

In yet another example of an attempt to reduce the explosion hazard in the casting of Al—Li alloys, U.S. Pat. No. 4,237,961, suggests removing water from the ingot during DC casting. In European Patent No. 0-183-563, a device is described for collecting the "break-out" or "run-out" molten metal during direct chill casting of aluminum alloys. Collecting the "break-out" or "run-out" molten metal would concentrate this mass of molten metal. This teaching cannot be used for Al—Li casting since it would create an artificial explosion condition where removal of the water would result in a pooling of the water as it is being collected for removal. During a "bleed-out" or "run-out" of the molten metal, the "bleed-out" material would also be concentrated in the pooled water area. As taught in U.S. Pat. No. 5,212,343, this would be a preferred way to create a reactive water/Al—Li explosion.

Thus, numerous solutions have been proposed in the prior art for diminishing or minimizing the potential for explosions in the casting of Al—Li alloys. While each of these proposed solutions has provided an additional safeguard in such operations, none has proven to be entirely safe or commercially cost effective.

Thus, there remains a need for safer, less maintenance prone and more cost effective apparatus and processes for casting Al—Li alloys that will simultaneously produce a higher quality of the cast product.

DETAILED DESCRIPTION

Figure 1:
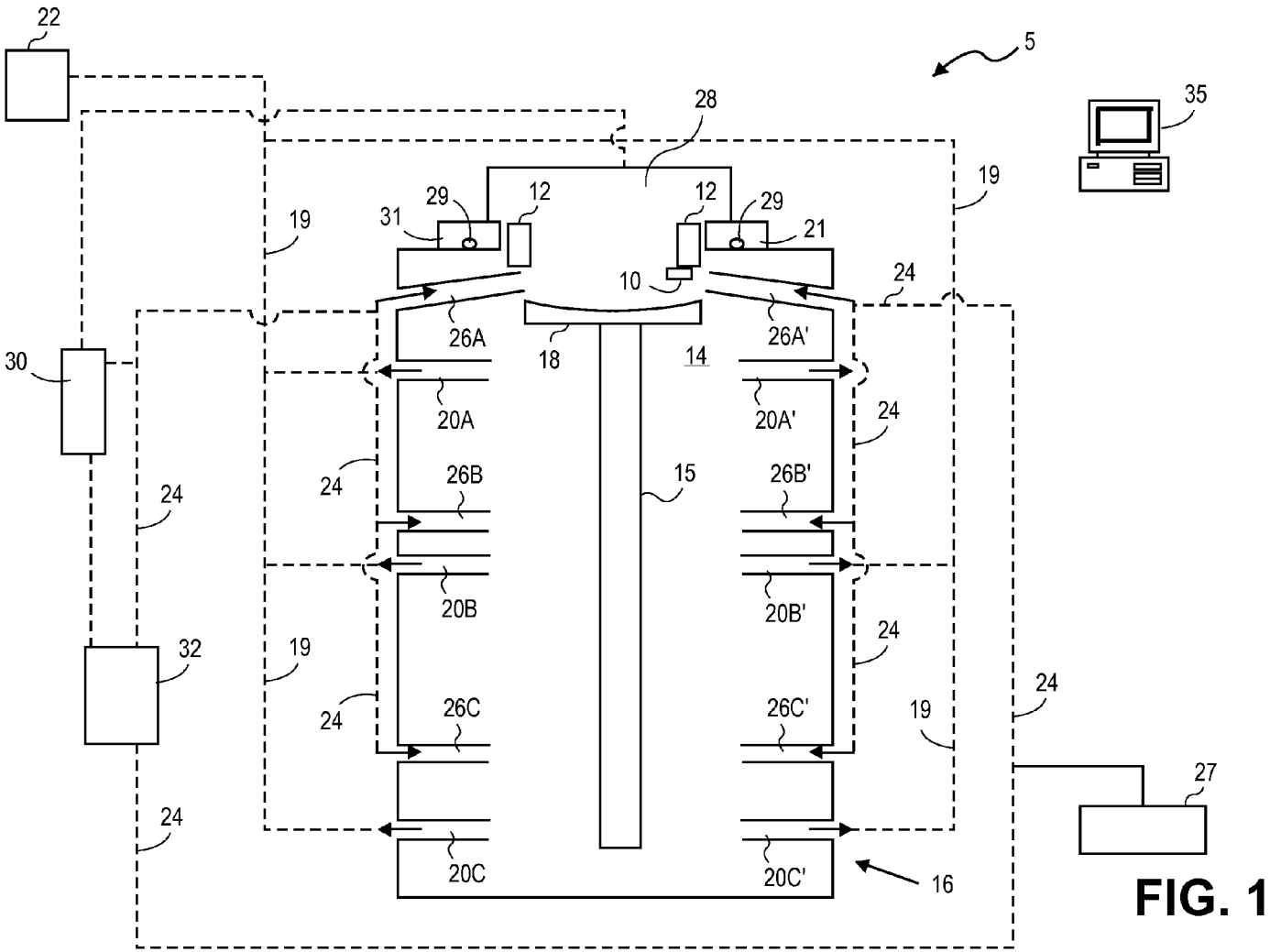
FIG. 1 is a simplified cross sectional side view of a direct chill casting pit in accordance with the present invention.

An apparatus and method for casting Al—Li alloys is described. A concern with prior art teachings is that water and the Al—Li molten metal "bleed-out" or "run-out" materials come together and release hydrogen during an exothermic reaction. Even with sloped pit bottoms, minimum water levels, etc., the water and "bleed-out" or "run-out" molten metal may still come into intimate contact, enabling the reaction to occur. Casting without water, using another liquid such as those described in prior art patents affects castability, quality of the cast product, is costly to implement and maintain, as well as poses environmental concerns and fire hazards.

The instantly described apparatus and method improve the safety of DC casting of Al—Li alloys by minimizing or eliminating ingredients that must be present for an explosion to occur. It is understood that water (or water vapor or steam) in the presence of the molten Al—Li alloy will produce hydrogen gas. A representative chemical reaction equation is believed to be:

$$2LiAl+8H_2O \rightarrow 2LiOH+2Al(OH)_3+4H_2(g).$$

Hydrogen gas has a density significantly less than a density of air. Hydrogen gas that evolves during the chemical reaction, being lighter than air, tends to gravitate upward, toward the top of a cast pit, just below the casting mold and mold support structures at the top of the casting pit. This typically enclosed area allows the hydrogen gas to collect and become concentrated enough to create an explosive atmosphere. Heat, a spark, or other ignition source can trigger the explosion of the hydrogen 'plume' of the as-concentrated gas.

It is understood that the molten "bleed-out" or "run-out" material when combined with the ingot cooling water that is used in a DC process (as practiced by those skilled in the art of aluminum ingot casting) will create steam and water vapor. The water vapor and steam are accelerants for the reaction that produces the hydrogen gas. Removal of this steam and water vapor by a steam removal system will remove the ability of the water to combine with Al-LI creating Li—OH, and the expulsion of $H_2$. The instantly described apparatus and method minimizes the potential for the presence of water and steam vapor in the casting pit by, in one embodiment, placing steam exhaust ports about the inner periphery of the casting pit, and rapidly activating the vents upon the detection of an occurrence of a "bleed out".

According to one embodiment, the exhaust ports are located in several areas within the casting pit, e.g., from about 0.3 meters to about 0.5 meters below the casting mold, in an intermediate area from about 1.5 meters to about 2.0 meters from the casting mold, and at the bottom of the cast pit. For reference, and as shown in the accompanying drawings described in greater detail below, a casting mold is typically placed at a top of a casting pit, from floor level to as much as one meter above floor level. The horizontal and vertical areas around the casting mold below the mold table are generally closed-in with a pit skirt and a Lexan glass encasement except for the provision to bring in and ventilate outside air for dilution purpose, such that the gasses contained within the pit are introduced and exhausted according to a prescribed manner.

In another embodiment, an inert gas is introduced into the casting pit interior space to minimize or eliminate the coalition of hydrogen gas into a critical mass. In this case, the inert gas is a gas that has a density less than a density of air and that will tend to occupy the same space just below the top of the casting pit that hydrogen gas would typically inhabit. Helium gas is one such example of suitable inert gas with a density less than a density of air.

The use of argon has been described in numerous technical reports as a cover gas for protecting Al—Li alloys from ambient atmosphere to prevent their reaction with air. Even though argon is completely inert, it has a density greater than a density of air and will not provide the inerting of the casting pit upper interior unless a strong upward draft is maintained. Compared to air as a reference (1.3 grams/liter), argon has density on the order of 1.8 grams/liter and would tend to settle to the bottom of a cast pit, providing no desirable hydrogen displacement protection within the critical top area of the casting pit. Helium, on the other hand, is nonflammable and has a low density of 0.2 grams per liter and will not support combustion. By exchanging air for a lower density of inert gas inside a casting pit, the dangerous atmosphere in the casting pit may be diluted to a level where an explosion cannot be supported. Also, while this exchange is occurring, water vapor and steam are also removed from the casting pit. In one embodiment, during steady state casting and when non-emergency condition pertaining to a 'bleed-out' is not being experienced, the water vapor and steam are removed from the inert gas in an external process, while the 'clean' inert gas can be re-circulated back through the casting pit.

Referring now to the accompanying drawings, FIG. 1 shows a cross-section of an embodiment of a DC casting system. DC system 5 includes casting pit 16 that is typically formed into the ground. Disposed within casting pit 16 is casting cylinder 15 that may be raised and lowered, for example, with a hydraulic power unit (not shown). Attached to a superior or top portion of casting cylinder 15 is platen 18 that is raised and lowered with casting cylinder 15. Above or superior to platen 18 in this view is stationary casting mold 12. Molten metal (e.g., Al—Li alloy) is introduced into mold 12. Casting mold 12, in one embodiment, includes, coolant inlets to allow coolant (e.g., water) to flow onto a surface of an emerging ingot providing a direct chill and solidification of the metal. Surrounding casting mold 12 is casting table 31. As shown in FIG. 1, in one embodiment, a gasket or seal 29 fabricated from, for example, a high temperature resistant silica material is located between the structure of mold 12 and table 31. Gasket 29 inhibits steam or any other atmosphere from below mold table 31 to reach above the mold table and thereby inhibits the pollution of the air in which casting crewmen operate and breathe.

In the embodiment shown in FIG. 1, system 5 includes molten metal detector 10 positioned just below mold 12 to detect a bleed out or run-out. Molten metal detector 10 may be, for example, an infrared detector of the type described in U.S. Pat. No. 6,279,645, a "break out detector" as described in U.S. Pat. No. 7,296,613 or any other suitable device that can detect the presence of a "bleed out".

In the embodiment shown in FIG. 1, system 5 also includes exhaust system 19. In one embodiment, exhaust system 19 includes, in this embodiment, exhaust ports 20A, 20A', 20B, 20B', 20C and 20C' positioned in casting pit 16. The exhaust ports are positioned to maximize the removal of generated gases including ignition sources (e.g., $H_2(g)$) and reactants (e.g., water vapor or steam) from the inner cavity of the casting pit. In one embodiment, exhaust ports 20A, 20A' are positioned about 0.3 meters to about 0.5 meters below mold 12; exhaust ports 20B, 20B' are positioned about 1.5 meters to about 2.0 meters below the mold 12; and exhaust ports 20C, 20C' are positioned at a base of casting pit 16 where bleed out metal is caught and contained. The exhaust ports are shown in pairs at each level. It is appreciated that, in an embodiment where there are arrays of exhaust ports at different levels such as in FIG. 1, there may be more than two exhaust ports at each level. For example, in another embodiment, there may be three or four exhaust ports at each level. In another embodiment, there may be less than two (e.g., one at each level). Exhaust system 19 also includes remote exhaust vent 22 that is remote from casting mold 12 (e.g., about 20 to 30 meters away from mold 12) to allow exit of exhausted gases from the system. Exhaust ports 20A, 20A', 20B, 20B', 20C, 20C' are connected to exhaust vent 22 through ducting (e.g., galvanized steel or stainless steel ducting). In one embodiment, exhaust system 19 further includes an array of exhaust fans to direct exhaust gases to exhaust vent 22.

FIG. 1 further shows gas introduction system 24 including, in this embodiment, inert gas introduction ports (e.g., inert gas introduction ports 26A, 26A', 26B, 26B', 26C and 26C') disposed around the casting pit and connected to an inert gas source or sources 27. In one embodiment, concurrent to positions of each of ports 26B and 26B', and 26C and 26C', there are positioned excess air introduction ports to assure additional in-transit dilution of the evolved hydrogen gas. The positioning of gas introduction ports is selected to provide a flood of inert gas to immediately replace the gases and steam within the pit, via a gas introduction system 24 that introduces inert gas as and when needed (especially upon the detection of the bleed-out) through inert gas introduction ports 26 into casting pit 16 within a predetermined time (e.g., about a maximum of 30 seconds) of the detection of a "bleed out" condition. FIG. 1 shows gas introduction ports 26A and 26A' positioned near a top portion of casting pit 16; gas introduction ports 26B and 26B' positioned at an intermediate portion of casting pit 16; and gas introduction ports 26C and 26C' positioned at a bottom portion of casting pit 16. Pressure regulators may be associated with each gas introduction port to control the introduction of an inert gas. The gas introduction ports are shown in pairs at each level. It is appreciated that, in an embodiment, where there are arrays of gas introduction ports at each level, there may be more than two gas introduction ports at each level. For example, in another embodiment, there may be three or four gas introduction ports at each level. In another embodiment, there may be less than two (e.g., one) at each level.

As shown in FIG. 1, in one embodiment, the inert gas introduced through gas introduction ports 26A and 26A' at top 14 of casting pit 16 should impinge on the solidified, semi-solid and liquid aluminum lithium alloy below mold 12, and inert gas flow rates in this area are, in one embodiment, at least substantially equal to a volumetric flow rate of a coolant prior to detecting the presence of a "bleed out" or a "run out". In embodiments where there are gas introduction ports at different levels of a casting pit, flow rates through such gas introduction ports may be the same as a flow rate through the gas introduction ports at top 14 of casting pit 16 or may be different (e.g., less than a flow rate through the gas introduction ports at top 14 of casting pit 16).

The replacement inert gas introduced through the gas introduction ports is removed from casting pit 16 by an upper exhaust system 28 which is kept activated at lower volume on continuous basis but the volume flow rate is enhanced immediately upon detection of a "bleed out" and directs inert gas removed from the casting pit to the exhaust vent 22. In one embodiment, prior to the detection of bleed out, the atmosphere in the upper portion of the pit may be continuously circulated through an atmosphere purification system consisting of moisture stripping columns and steam desiccants thus keeping the atmosphere in the upper region of the pit reasonably inert. The removed gas while being circulated is passed through the desiccant and any water vapor is removed to purify the upper pit atmosphere containing inert gas. The purified inert gas may then be re-circulated to inert gas injection system 24 via a suitable pump 32. When this embodiment is employed, inert gas curtains are maintained, between the ports 20A and 26A and similarly between the ports 20A' and 26A' to minimize the escape of the precious inert gas of the upper region of the casting pit through the pit ventilation and exhaust system.

The number and exact location of exhaust ports 20A, 20A', 20B, 20W, 20C, 20C' and inert gas introduction ports 26A, 26A', 26B, 26B', 26C, 26C' will be a function of the size and configuration of the particular casting pit being operated and these are calculated by the skilled artisan practicing DC casting in association with those expert at recirculation of air and gases. It is most desirable to provide the three sets (e.g., three pairs) of exhaust ports and inert gas introduction ports as shown FIG. 1. Depending on the nature and the weight of the product being cast, a somewhat less complicated and less expensive but equally effective apparatus can be obtained using a single array of exhaust ports and inert gas introduction ports about the periphery of the top of casting pit 16.

Figure 2:
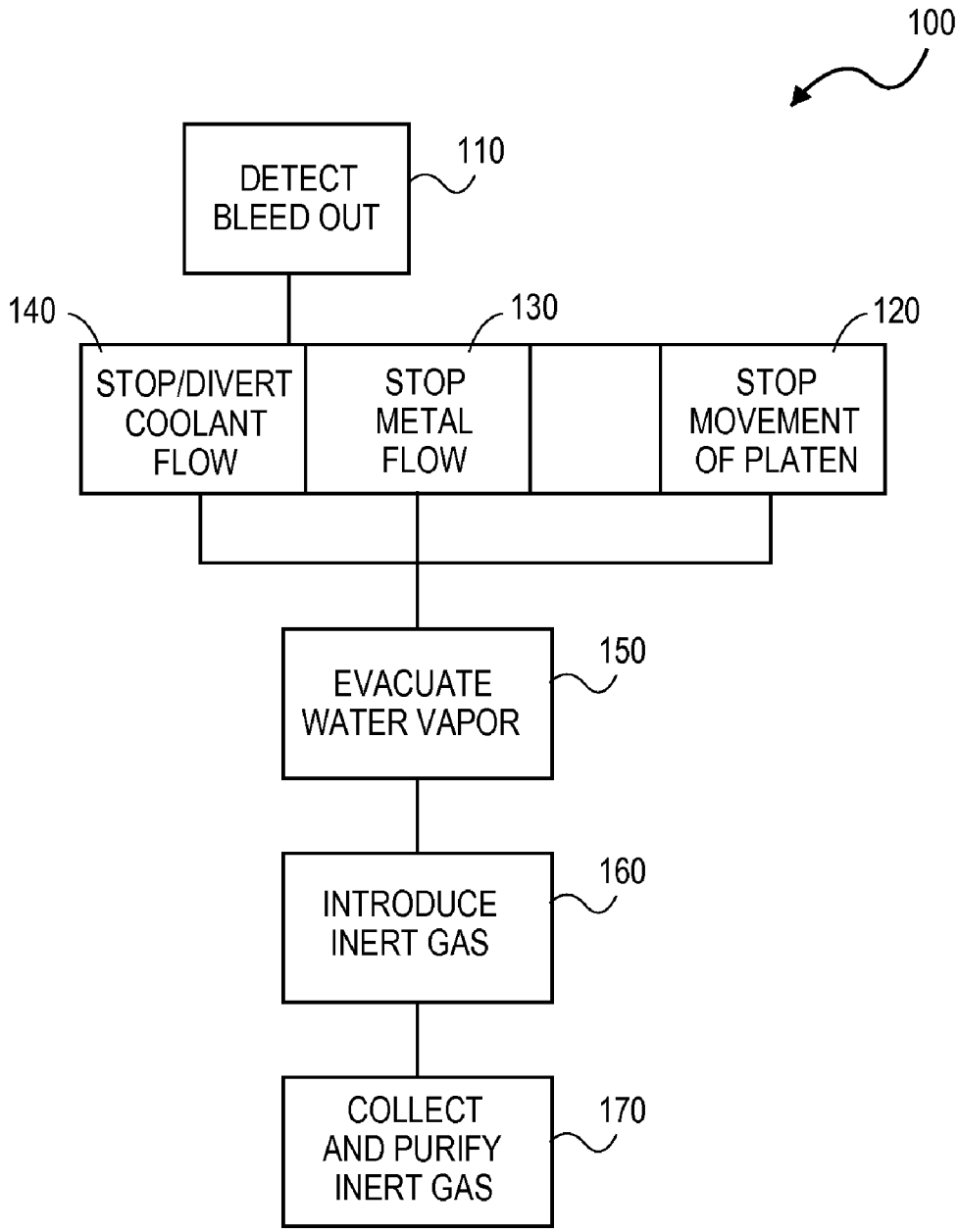
FIG. 2 is a process flow diagram of a preferred embodiment of process of the present invention.

In one embodiment, each of a movement of platen 18/casting cylinder 15, a molten metal supply inlet to mold 12 and a water inlet to the mold are controlled by controller 35. Molten metal detector 10 is also connected to controller 35. Controller 35 contains machine-readable program instructions as a form of non-transitory tangible media. In one embodiment, the program introductions are illustrated in the method of FIG. 2. Referring to FIG. 2 and method 100, first an Al—Li molten metal "bleed out" or "run out" is detected by molten metal detector 10 (block 110). In response to a signal from molten metal detector 10 to controller 35 of an Al—Li molten metal "bleed-out" or "run-out", the machine readable instructions cause movement of platen 18 and molten metal inlet supply (not shown) to stop (blocks 120, 130), coolant flow (not shown) into mold 12 to stop and/or be diverted (block 140), and higher volume exhaust system 19 to be activated simultaneously or within about 15 seconds and in another embodiment, within about 10 seconds, to divert the water vapor containing exhaust gases and/or water vapor away from the casting pit via exhaust ports 20A, 20A', 20B, 20B', 20C and 20C' to exhaust vent 22 (block 150). At the same time or shortly thereafter (e.g., within about 10 seconds to within about 30 seconds), the machine readable instructions further activate gas introduction system and an inert gas having a density less than a density of air, such as helium, is introduced through gas introduction ports 26A, 26A', 26B, 26B', 26C and 26C' (block 160). It is to be noted that those skilled in the art of melting and direct chill casting of aluminum alloys except the melting and casting of aluminum-lithium alloys may be tempted to use nitrogen gas in place of helium because of the general industrial knowledge that nitrogen is also an 'inert' gas. However, for the reason of maintaining process safety, it is mentioned herein that nitrogen is really not an inert gas when it comes to interacting with liquid aluminum-lithium alloys. Nitrogen does react with the alloy and produces ammonia which in turns reacts with water and brings in additional reactions of dangerous consequences, and hence its use should be completely avoided. The same holds true for another presumably inert gas carbon di oxide. Its use should be avoided in any application where there is a finite chance of molten aluminum lithium alloy to get in touch with carbon di oxide.

A significant benefit obtained through the use of an inert gas that is lighter than air is that the residual gases will not settle into the casting pit, resulting in an unsafe environment in the pit itself. There have been numerous instances of heavier than air gases residing in confined spaces resulting in death from asphyxiation. It would be expected that the air within the casting pit will be monitored for confined space entry, but no process gas related issues are created.

The process and apparatus described herein provide a unique method to adequately contain Al—Li "bleed-outs" or "run-outs" such that a commercial process can be operated successfully without utilization of extraneous process methods, such as casting using a halogenated liquid like ethylene glycol that render the process not optimal for cast metal quality, a process less stable for casting, and at the same time a process which is uneconomical and flammable. As anyone skilled in the art of ingot casting will understand, it must be stated that in any DC process, "bleed-outs" and "run-outs" will occur. The incidence will generally be very low, but during the normal operation of mechanical equipment, something will occur outside the proper operating range and the process will not perform as expected. The implementation of the described apparatus and process and use of this apparatus will minimize water-to-molten metal hydrogen explosions from "bleed-outs" or "run-outs" while casting Al—Li alloys that result in casualties and property damage.

There has thus been described a commercially useful method and apparatus for minimizing the potential for explosions in the direct chill casting of Al—Li alloys.

As the invention has been described, it will be apparent to those skilled in the art that the same may be varied in many ways without departing from the spirit and scope of the invention. Any and all such modifications are intended to be included within the scope of the appended claims.

What is claimed is:

1. A process for minimizing the potential for explosions in the direct chill casting of aluminum lithium alloys wherein molten metal is introduced into a casting mold and cooled by the impingement of a liquid coolant on the solidifying metal in a casting pit having top, intermediate and bottom portions and including a movable platen comprising:

detecting an occurrence of a bleed out or a run out;

after detecting, halting any flow of molten metal, halting a flow of liquid coolant into the casting mold, and stopping any motion of the platen;

exhausting generated gas from the casting pit at enhanced flow volume rate by using an exhausting mechanism; and introducing an inert gas into the casting pit, the inert gas having a density less than a density of air.

2. The process of claim 1, wherein the inert gas is helium.

3. The process of claim 1, wherein exhausting generated gas from the casting pit comprises exhausting by an array of exhaust ports about at least a periphery of a top portion of the casting pit.

4. The process of claim 3, wherein exhausting generated gas further comprises exhausting by arrays of exhaust ports about the intermediate and bottom portions of the casting pit.

5. The process of claim 1, wherein introducing an inert gas comprises introducing an inert gas through an array of gas introduction ports about a periphery of at least a top portion of the casting pit.

6. The process of claim 1, wherein introducing an inert gas comprises introducing an inert gas through arrays of gas introduction ports about a periphery of a top portion, an intermediate portion and a bottom portion of the casting pit.

7. The process of claim 1, wherein enhanced exhausting of generated gas commences at a maximum of 15 seconds after detection of a bleed out.

8. The process of claim 1, wherein introducing an inert gas in to the pit commences within a maximum of about 15 seconds after detection of a bleed out.

9. The process of claim 1, wherein exhausting of generated gas comprises exhausting to a location at least 20 meters from the casting mold.

10. The process of claim 1, wherein introducing an inert gas comprises impinging upon a solid, semi-solid or liquid metal portion of an ingot being cast at a flow rate substantially equal to a volumetric flow rate selected for a coolant prior to detecting a bleed out or run out.

11. The process of claim 1, further comprising purifying inert gas via a gas purification system.

12. An apparatus comprising:

a casting pit having top, intermediate and bottom portions;

a mold located at a top portion of the casting pit;

a mechanism for introducing coolant for cooling molten metal into a solid shape as it passes through the mold, a downward moving platen supporting the solid shape as it solidifies in the mold;

a mechanism for detecting the occurrence of a bleed out;

a mechanism for halting and/or diverting the flow of coolant upon the detection of a bleed out;

a mechanism for halting a downward movement of the platen upon detection of a bleed out;

an array of exhaust ports about at least a top periphery of the casting pit; and an array of inert gas introduction ports about at least the top periphery of the casting pit.

13. The apparatus of claim 12, further comprising arrays of exhaust ports about a periphery of the intermediate and bottom portions of the casting pit.

14. The apparatus of claim 12, further comprising arrays of inert gas introduction ports about the intermediate and bottom portions of the casting pit.

15. The apparatus of claim 12, further comprising a mechanism for removing generated gas to a location at least 20 meters from the mold.

16. The apparatus of claim 13, further including at the top portion of the casting pit a mechanism for collecting inert gas exiting the casting pit, purifying the inert gas by removal of steam and vapor and re-circulating it to the casting pit.

17. The apparatus of claim 13, wherein the arrays of exhaust ports comprise:

a first array located from about 0.3 to about 0.5 meters below the mold;

a second array located from about 1.5 to about 2.0 meters from the mold; and a third array located at the bottom of casting pit.

18. The apparatus of claim 13, further comprising:

a mechanism for continuously removing generated gas from the casting pit through the exhaust ports; and a mechanism for suction of water vapor and any other gases from the top portion of the casting pit and continuously removing water from such mixture and recirculating any other gases to the same upper area of the casting pit when bleed out is not detected, but completely exhausting water vapor and other gases from the upper area when bleed out is detected.

19. The apparatus of claim 13, wherein water vapor is continuously exhausted from the exhaust ports with excess amount of dry dilution air.

* * * * *